US006163661A

United States Patent [19]

Namekata et al.

[11] Patent Number: 6,163,661

[45] Date of Patent: Dec. 19, 2000

[54] ELECTROSTATIC IMAGE FORMING APPARATUS CAPABLE OF REDUCING DEFECTIVE IMAGE TRANSFER CAUSED BY FREE TONER PARTICLES DEPOSITED ON A CORONA DISCHARGER

[75] Inventors: Shinichi Namekata; Yuji Sawai, both of Yokohama; Toshiaki Motohashi, Souka; Katsuya Kawagoe, Kamakura, all of Japan

[73] Assignee: Ricoh Company, Ltd., Tokyo, Japan

[21] Appl. No.: 09/205,712

[22] Filed: Dec. 4, 1998

Related U.S. Application Data

[63] Continuation of application No. 08/647,048, May 9, 1996, Pat. No. 5,890,030.

[30] Foreign Application Priority Data

May 11, 1995 [JP] Japan ..... 7-113031
Apr. 22, 1996 [JP] Japan ..... 8-100390

[51] Int. Cl.[7] ..... G03G 15/00; G03G 15/16

[52] U.S. Cl. ..... 399/44; 250/324; 399/66; 399/101; 399/314

[58] Field of Search ..... 399/44, 66, 310, 399/311, 314, 101; 250/324–326

[56] References Cited

U.S. PATENT DOCUMENTS 4,341,457 7/1982 Nakahata et al. ..... 399/314
4,912,515 3/1990 Amemiya et al. ..... 399/44
5,128,717 7/1992 Uchikawa et al. ..... 399/44

*Primary Examiner*—William J. Royer
*Attorney, Agent, or Firm*—Oblon, Spivak, McClelland, Maier & Neustadt, P.C.

[57] ABSTRACT

In an electrostatic image forming apparatus, including a corona discharger located so as to face an image carrier on which a toner image is to be formed. When a paper or similar recording medium is brought between the image carrier and the discharger, the discharger effects corona discharge at the rear of the recording medium so as to charge the medium to a polarity opposite to the polarity of the toner image. The toner image is then transferred from the image carrier to the recording medium. A polarity switcher allows a voltage of substantially the same polarity as the toner to be applied to a discharge wire included in the discharger, and environmental sensing device allows this voltage to be changed based on temperature and humidity conditions. The apparatus is free from defective discharge and defective image transfer ascribable to the deposition of free or isolated toner on the discharger.

6 Claims, 10 Drawing Sheets

ELECTROSTATIC IMAGE FORMING APPARATUS CAPABLE OF REDUCING DEFECTIVE IMAGE TRANSFER CAUSED BY FREE TONER PARTICLES DEPOSITED ON A CORONA DISCHARGER

This application is a Continuation of application Ser. No. 08/647,048 filed on May 9, 1996, now U.S. Pat. No. 5,890,030.

BACKGROUND OF THE INVENTION

1. Field of the Invention

The present invention relates to an electrostatic image forming apparatus capable of reducing defective discharge and defective image transfer ascribable to the deposition of free toner particles on a corona discharger.

2. Discussion of the Background

In a conventional electrostatic image forming apparatus, a corona discharger is located so as to face an image carrier on which a toner image is to be formed. When a paper or similar recording medium is brought between the image carrier and the discharger, the discharger effects corona discharge at a rear end of the paper so as to charge the paper to a polarity opposite to a polarity of toner forming a toner image. As a result, the toner image is transferred from the image carrier to the paper. This type of apparatus will be referred to as Prior Art 1.

In another conventional electrostatic image forming apparatus, charging means, exposing means, developing means and primary transfer means are arranged around a photoconductive element while an intermediate transfer medium is interposed between the photoconductive element and the primary transfer means. Secondary transfer means is positioned around the intermediate transfer medium. A paper or similar recording medium is passed through a gap between the intermediate transfer medium and the secondary transfer means. In operation, the charging means uniformly charges the surface of the photoconductive element to a preselected polarity. The exposing means exposes the charged surface of the element in accordance with image data, thereby forming a latent image. The developing means develops the latent image with toner to thereby produce a corresponding toner image. The primary transfer means is applied with a voltage opposite in polarity to the toner image so as to transfer the toner image to the intermediate transfer medium. The secondary transfer means is applied with a voltage opposite in polarity to the toner image carried on the intermediate transfer medium so as to transfer the toner image to the paper. This type of apparatus will be referred to as Prior Art 2.

To form a full-color image, Prior Art 1 sequentially forms color images of different colors on the image carrier one above the other, and then collectively transfers the resulting laminate or composite image to the paper. On the other hand, Prior Art 2 repeats the primary transfer to form the laminate toner image on the intermediate transfer medium, and then transfers it to the paper.

The intermediate transfer medium is implemented as a belt or a drum having medium resistance, i.e., a volume resistivity of $1\times10^{8}$ Ωcm to $10^{12}$ Ωcm and a surface resistivity of $1\times10^{8}$ Ω to $10^{11}$ Ω, as measured by a test prescribed by JIS (Japanese Industrial Standards) K6911. Should the transfer medium have high resistance, its charge potential would sequentially increase due to a bias repeatedly applied thereto for the primary transfer, rendering the primary and secondary transfer defective. If the intermediate medium has medium resistance and discharges by way of a conductive support member supporting it, then the charge of the medium can be maintained substantially constant despite the repeated primary transfer during the formation of a full-color image.

For the transfer of the toner image, use has customarily been made of a bias roller or a corona discharger. As for a bias roller, if it contacts the image transferred by the primary transfer means during the formation of a full-color image, then it disturbs the image. Hence, the bias roller must be spaced from the intermediate transfer medium until the image transferred by the primary transfer means moves away from the roller. This cannot be done without resorting to a mechanism for moving the bias roller into and out of contact with the intermediate transfer medium. Such a mechanism is complicated and bulky resulting in extra cost.

In light of the above, the bias roller may be replaced with a corona discharger which does not contact the toner image at all, as proposed in relation to both of Prior Art 1 and Prior Art 2.

In Prior Art 1 and Prior Art 2, discharging means in the form of a brush or needles may be used to separate the paper moved away from an image transfer position from the image carrier by discharging the paper charged by the corona discharger, as needed. In the event of image transfer, an AC voltage or a voltage opposite in polarity to the voltage applied to the corona discharger is applied to the discharging means. Alternatively, the discharging means may be simply connected to ground without any voltage applied thereto. This type of apparatus will be referred to as Prior Art 3.

The apparatus using the intermediate transfer medium having medium resistance has the following problems left unsolved. The adhesion of the toner image to the intermediate transfer medium is weaker than the adhesion of the same to the image carrier, so that the toner is easily isolated from the intermediate transfer medium. Moreover, in the event of image transfer to the paper, the intermediate transfer medium passes by the secondary transfer means three consecutive times. When the color switching time available for the developing means is short, the medium passes by the secondary transfer means even six consecutive times because a single idle rotation occurs between the consecutive transfers.

In any case, when the toner image is conveyed via the secondary transfer means by the intermediate transfer medium, isolated or free toner particles appear due to the weak adhesion of the toner image to the intermediate transfer medium. This is particularly true with the laminate toner image portion. When discharge begins for the secondary transfer, the free particles are electrostatically attracted by the discharge wire of the corona discharger. The free particles deposited on the discharge wire results in defective discharge and defective image transfer. This occurs not only in Prior Art 2 but also in Prior Art 1.

In Prior Art 3, the discharging means, like the corona discharger, is applied to a color image forming apparatus using the intermediate transfer medium. In this case, the toner deposited on the intermediate transfer medium flies about and contaminates the discharging means when the toner image passes through the image transfer position. It is likely that the toner deposited on the discharging means is transferred to the rear of the paper. To solve this problem, a voltage of the same polarity as the toner may be applied to the discharging means. However, the discharging means is different from the wire and casing of the corona discharger in that it is positioned extremely close to the surface of the image carrier. In addition, the discharging means, whether it be a brush or needles, is apt to cause discharge to occur between its tips and the surface of the image carrier. The discharge electrically disturbs the toner image carried on the image carrier. Although the discharging means may be simply connected to ground without any voltage applied thereto, this kind of scheme cannot prevent the toner from flying away from the image carrier and therefore fails to free the discharging means from contamination.

SUMMARY OF THE INVENTION

It is therefore an object of the present invention to provide an electrostatic image forming apparatus capable of reducing defective discharge and defective image transfer ascribable to the deposition of free toner particles on a corona discharger or discharging means associated with the discharger.

In accordance with the present invention, a n electrostatic image forming apparatus has an image carrier for forming a toner image thereon. A corona discharger has a casing and a discharge wire disposed in the casing and effects corona discharge at the rear of a recording medium arrived thereat. The corona discharge charges the recording medium to a polarity opposite to the charge polarity of the toner image formed on the image carrier and thereby transfers the toner image to the recording medium. A polarity switching device allows a voltage of substantially the same polarity as the toner image to be applied to the discharge wire at a time other than the time when the toner image is transferred to the recording medium.

Also, in accordance with the present invention, a n electrostatic image forming apparatus has an image carrier for forming a toner image thereon. A corona discharger has a conductive casing and a discharge wire disposed in the casing and effects corona discharge at the rear of a recording medium arrived thereat. The corona discharge charges the recording medium to a polarity opposite to the charge polarity of the toner image formed on the image carrier and thereby transfers the toner image to the recording medium. A polarity switching device allows a voltage of substantially the same polarity as the toner image to be applied to each of the casing and discharge wire at a time other than the time when the toner image is transferred to the recording medium.

Further, in accordance with the present invention, an electrostatic image forming apparatus has an image carrier for forming a toner image thereon. A corona discharger faces the image carrier and has a casing and a discharge wire disposed in the casing. The discharger effects corona discharge at the rear of a recording medium fed thereto. The discharge charges the recording medium to a polarity opposite to the charge polarity of the toner image formed on the image carrier and thereby transfers the toner image to the recording medium. A voltage changing device applies a voltage of substantially the same polarity as the charge of the toner image to at least the discharge wire of the corona discharger, and changes the voltage. An environment sensing device senses an environment in which the apparatus is situated. A controller controls, based on the environment sensed, the voltage to be applied by the voltage changing device.

Further, in accordance with the present invention, an electrostatic image forming apparatus has an image carrier for forming a toner image thereon. A charger uniformly charges the image carrier in the event of image formation. An exposing device exposes the image carrier charged in accordance with image data to thereby form a latent image. A developing unit develops the latent image with toner to thereby produce a corresponding toner image. An intermediate transfer medium has a medium resistance. A primary transfer unit is applied with a voltage opposite in polarity to the toner image for transferring the toner image to the intermediate transfer medium. A secondary transfer unit is applied with a voltage opposite in polarity to the toner image carried on the intermediate transfer medium, and transfers the toner image from the intermediate transfer medium to a recording medium. The secondary transfer unit is a corona discharger made up of a casing and a discharge wire disposed in the casing. A polarity switching device applies a voltage of substantially the same polarity as the toner image to at least the discharge wire of the secondary transfer unit.

Furthermore, in accordance with the present invention, an electrostatic image forming apparatus has an image carrier for forming a toner image thereon. A charger uniformly charges the image carrier in the event of image formation. An exposing device exposes the image carrier charged in accordance with image data to thereby form a latent image. A developing unit develops the latent image with toner to thereby produce a corresponding toner image. An intermediate transfer medium has a medium resistance. A primary transfer unit is applied with a voltage opposite in polarity to the toner image for transferring the toner image to the intermediate transfer medium. A secondary transfer unit is applied with a voltage opposite in polarity to the toner image carried on the intermediate transfer medium and transfers the toner image from the intermediate transfer medium to a recording medium. The secondary transfer unit is a corona discharger made up of a conductive casing and a discharge wire disposed in the casing. A polarity switching device applies a voltage of substantially the same polarity as the toner image to each of the discharge wire and casing of the secondary transfer unit.

Moreover, in accordance with the present invention, an electrostatic image forming apparatus has an image carrier for forming a toner image thereon. A charger uniformly charges the image carrier in the event of image formation. An exposing device exposes the image carrier charged in accordance with image data to thereby form a latent image. A developing unit develops the latent image with toner to thereby produce a corresponding toner image. An intermediate transfer medium has a medium resistance. A primary transfer unit is applied with a voltage opposite in polarity to the toner image for transferring the toner image to the intermediate transfer medium. A secondary transfer unit is applied with a voltage opposite in polarity to the toner image carried on the intermediate transfer medium and transfers the toner image from the intermediate transfer medium to a recording medium. The secondary transfer unit is a corona discharger made up of a conductive casing and a discharge wire disposed in the casing. A voltage changing device applies a voltage of substantially the same polarity as the charge of the toner image to at least the discharge wire of the corona discharger, and changes the voltage. An environment sensing device senses an environment in which the apparatus is situated. A controller controls, based on the environment sensed, the voltage to be applied by the voltage changing device.

In addition, in accordance with the present invention, an electrostatic image forming apparatus has an image carrier for forming a toner image thereon, and an intermediate transfer medium. A transferring unit faces the image carrier or the intermediate transfer medium and electrostatically transfers the toner image from the image carrier or the intermediate transfer medium to a recording medium by being applied with a voltage of a polarity opposite to the charge polarity of the toner image. A discharging unit is located downstream of the transferring unit in the direction in which the recording medium is transported, and discharges the recording medium. A voltage applying device has a conductive member adjoining the discharging unit and applies a voltage of the same polarity as the charge polarity of the toner image to the conductive member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
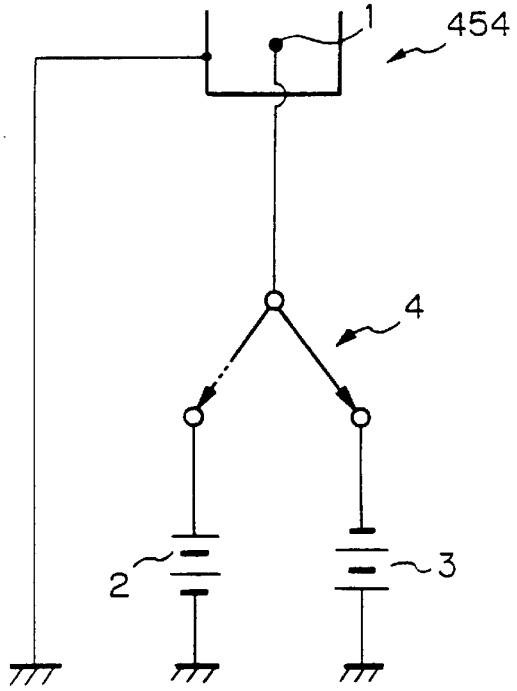
FIG. 1 is a circuit diagram showing means for switching a voltage to be applied to a discharge wire included in a corona discharger.

To better understand the present invention, two different types of electrostatic image forming apparatuses to which the present invention is applicable will be described.

First, an electrostatic color image forming apparatus of the type using an intermediate transfer medium will be described with reference to FIGS. 8 and 9. As shown, the apparatus has a color scanner 200 for reading a document image color by color and outputting color image data in the form of electric signals. An optical writing unit or exposing means 400 transforms the color image data to a corresponding optical signal. The writing unit 400 optically writes an image representative of the document image on a photoconductive drum or image carrier 402 in response to the optical signal, thereby electrostatically forming a latent image. The writing unit 400 includes a laser diode (LD) or laser beam emitting means 404, a section, not shown, for controllably driving the LD 404, a polygonal mirror 406, a motor 408 for driving the mirror 406, an f-theta lens 410, and a mirror 412.

Figure 8:
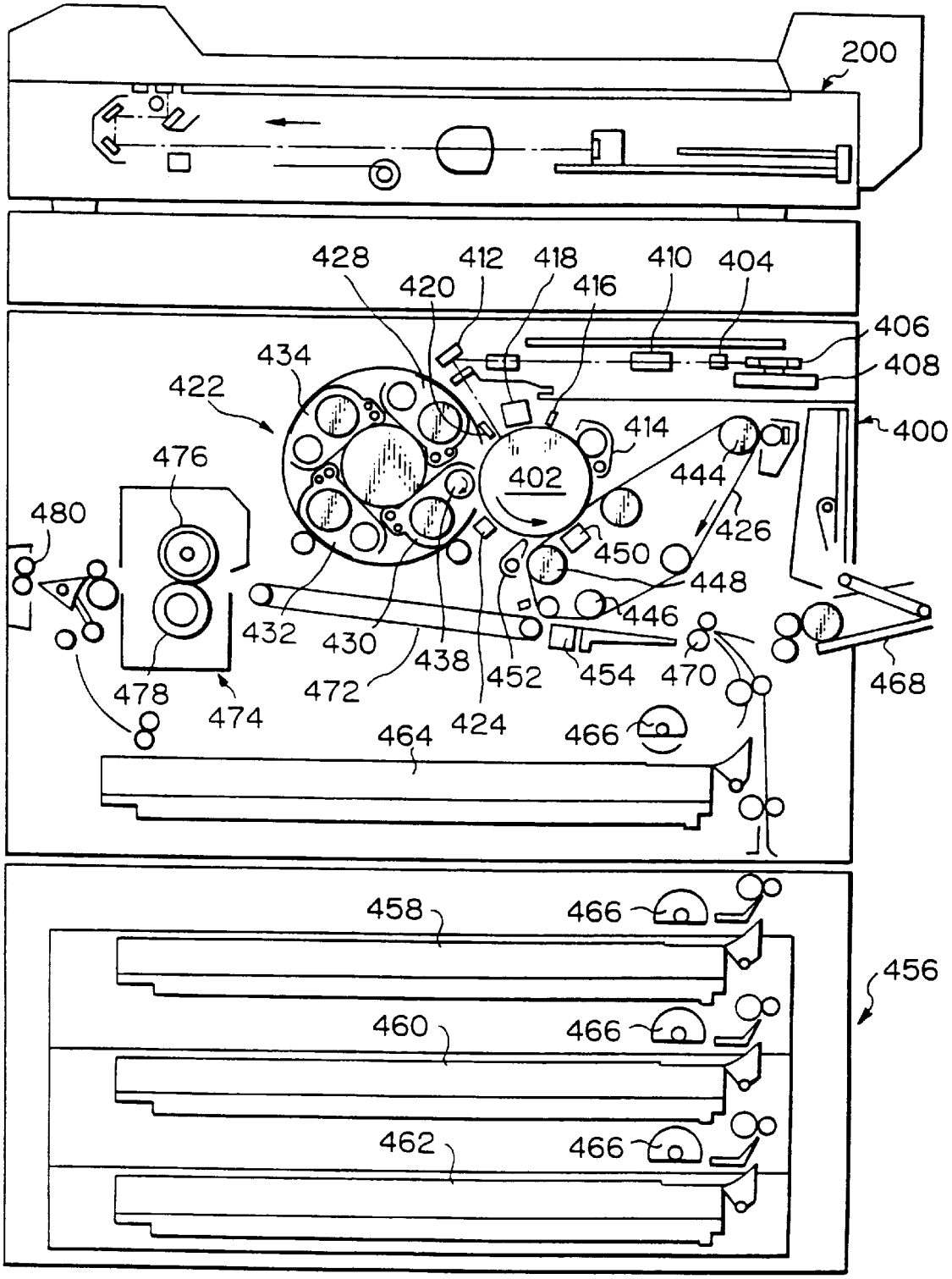
FIG. 8 is a section showing the general construction of an electrostatic image forming apparatus of the type using an intermediate transfer medium.
Figure 9:
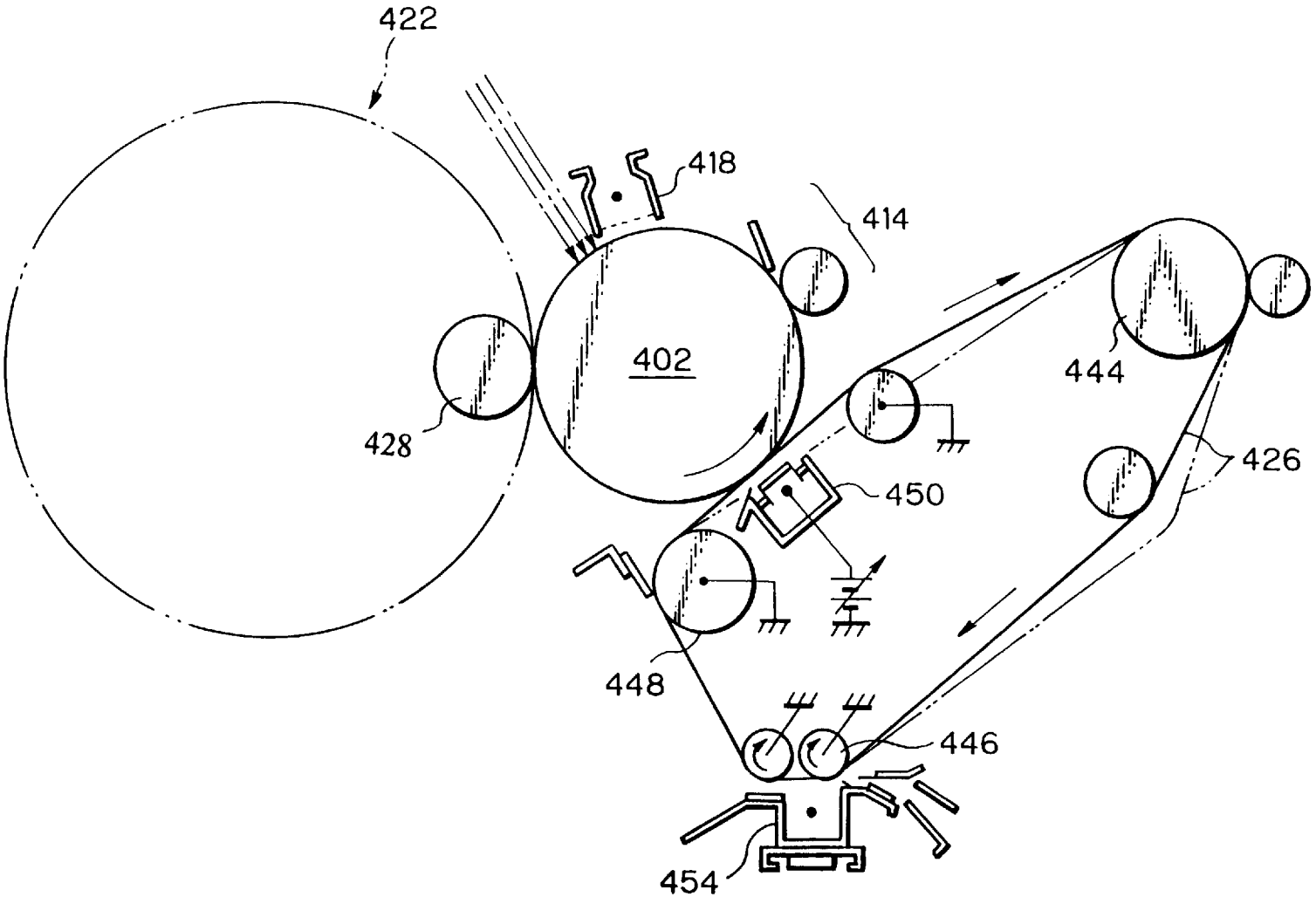
FIG. 9 is a fragmentary view of the apparatus shown in FIG. 8.

The drum 402 is rotatable counterclockwise, as indicated by an arrow in FIGS. 8 and 9. Arranged around the drum are a drum cleaning unit 414, a discharge lamp 416, a potential sensor 420, a rotatable developing unit or revolver 422, a density pattern sensor 424, and an intermediate transfer medium in the form of a belt 426. The belt 426 is formed of, e.g., ethylene tetrafluoroethylene (ETFE) or epichlorohydrin rubber and has a medium resistance, i.e., a volume resistivity between $1\times10^8$ Ωcm and $10^{12}$ Ωcm and a surface resistivity between $1\times10^8$ Ω and $10^{11}$ Ω (JIS K6911). The belt 426 may be replaced with a drum, if desired.

The revolver 422 is partitioned into a black (Bk) developing chamber 428, a cyan (C) developing chamber 430, a magenta (M) developing chamber 432, and a yellow (Y) developing chamber 434. The revolver 422 is caused to rotate by a drive section, not shown. The chambers 428, 430, 432, 434 each accommodate a developing sleeve 438 and a paddle. The developing sleeve 438 is rotatable with a developer deposited thereon contacting the surface of the drum 402. The paddle scoops up the developer while agitating it.

As shown in FIGS. 8 and 9, in a stand-by condition, the revolver 422 is positioned such that the Bk developing chamber 428 faces the drum 402. On the start of a copying operation, the color scanner 200 starts reading a Bk component of the document at a preselected timing while generating corresponding Bk image data. The writing unit 400 forms a latent image represented by the Bk image data on the drum 402. Let the latent images based on the Bk image data, C image data, M image data and Y image data be referred to as a Bk latent image, C latent image, M latent image, and Y latent image, respectively. Before the leading edge of the Bk latent image reaches a developing position where the Bk developing chamber 428 is located, the developing sleeve 438 disposed in the chamber 428 begins to rotate in order to develop the latent image with Bk toner from the leading edge to the trailing edge. As soon as the trailing edge of the Bk latent image moves away from the developing position, the revolver 422 is rotated to bring the next developing chamber to the developing position. This rotation is ended at least before the leading edge of the next latent image arrives at the developing position.

On the start of the above image forming cycle, the drum 402 and belt 426 are respectively rotated counterclockwise and clockwise by a motor, not shown. A Bk toner image, C toner image, M toner image and Y toner image are sequentially formed on the drum 402 and sequentially transferred to the belt 426 one above the other. As a result, a composite or full-color toner image is formed on the belt 426.

To promote the rapid register of the leading edges of the consecutive toner images, rollers supporting the belt 426 are moved so as to space the belt 426 from the drum 402. In this condition, the belt 426 is fed at a speed higher than the usual speed.

Specifically, to form the Bk toner image, a charger or charging means 418 uniformly charges the surface of the drum 402 to about −700 V by corona discharge.

Subsequently, the LD 404 exposes the charged surface of the drum 402 by raster scanning on the basis of the Bk image data. As a result, the exposed surface of the drum 402 loses its potential in proportion to the quantity of incident light, so that the Bk latent image is formed on the drum 402.

The Bk toner stored in the Bk developing chamber 428 is charged to the negative polarity by being agitated together with ferrite carrier. Power supply means, not shown, applies a bias consisting of an AC-biased negative DC potential to the developing sleeve 438 disposed in the chamber 428. Consequently, the Bk toner is deposited on the exposed portion of the drum 402 which has lost the charge, forming the Bk toner image.

The belt 426 is passed over a drive roller 444, an image transfer counter-roller 446, a cleaning counter-roller 448, and a plurality of driven rollers. The belt 426 is driven by a motor, not shown, via the drive roller 444.

While the belt 426 is rotated at a constant speed in contact with the drum 402, the Bk toner image is transferred from the drum 402 to the belt 426 by a corona discharger 450. The transfer of the toner image from the drum 402 to the belt 426 is referred to as a primary transfer. The discharge efficiency (distribution ratio) of the corona discharger 450 ranges from about 15% to about 35%.

The drum cleaning unit 414 removes the toner left on the drum 402 after the primary transfer, so that the drum 402 is prepared for the next color. The toner removed by the cleaning unit 414 is collected in a waste toner tank, not shown, via a collection conduit.

The Bk, C, M and Y toner images are sequentially transferred from the drum 402 to the belt 426 one above the other, as stated earlier. The resulting laminate or full-color image is transferred from the belt 426 to a paper or similar recording medium by a corona discharger 454. The transfer of the toner image from the belt 426 to the paper is referred to as a secondary transfer.

After the trailing edge of the next or C latent image has moved away from the developing position, the revolver 422 is rotated to bring the M developing chamber 432 to the developing position. This is also ended before the leading edge of the M latent image arrives at the developing position.

The procedures relating to the M latent image and Y latent image will not be described specifically because they are formed in the same manner as the Bk and C latent images.

As for the corona discharger or secondary transfer means 454, DC or an AC and DC combination is applied to transfer the laminate color image from the belt 426 to the paper. The distribution ratio of the discharger 454 is about 15% to about 35% like the distribution ratio of the discharger 450.

As shown in FIG. 8, a paper cassette 464 is accommodated in the body of the apparatus. A paper bank 456 has paper cassettes 458, 460 and 462 each being loaded with a stack of papers different in size from papers stored in the cassette 464. Papers of desired size are sequentially fed from one of the cassettes 464, 458, 460 and 462 toward a registration roller pair 470 by a pick-up roller 466 associated with the cassette. The reference numeral 468 designates a manual tray which allows OHP sheets, thick sheets and other special sheets to be fed by hand.

The paper reached the registration roller pair 470 is brought to a stop thereby. When the leading edge of the laminate image formed on the belt 426 is about to reach the discharger 454, the roller pair 470 again drives the paper such that the leading edge of the paper accurately meets the leading edge of the laminate image.

The paper is entrained by the belt 426 over the discharger 454 connected to the positive potential. At this instant, the discharger 454 charges the paper to the positive polarity by corona discharge with the result that the toner image is transferred from the belt 426 to the paper. While the paper passes by a discharge brush, not shown, located at the left-hand side of the discharger 454, the brush dissipates the charge of the paper. Consequently, the paper is separated from the belt 426 and then transferred to a conveyor belt 472.

The conveyor belt 472 conveys the paper to a fixing unit 474 having a heat roller 476 and a press roller 478. The heat roller 476 controlled to a preselected temperature and the press roller 478 cooperate to fix the toner on the paper at their nip. The paper coming out of the fixing unit 474 is driven out of the apparatus by an outlet roller pair 480. The paper or full-color copy is laid on a copy tray, not shown, face up.

After the primary transfer, the surface of the drum 402 is cleaned by the drum cleaning unit 414 and then uniformly discharged by the discharge lamp 416. After the secondary transfer, the belt 426 is again pressed against a belt cleaning unit 452 by a blade and has its surface cleaned thereby.

In a repeat copy mode, after the fourth color component of the first image has been transferred from the drum 402 to the belt 426, the first color component of the second image is formed at a preselected timing. Specifically, after the secondary transfer of the first laminate image to the paper, a black toner image for the second laminate image is transferred from the drum 402 to the area of the belt 426 cleaned by the cleaning unit 452. This is followed by the same procedure as described in relation to the first copy.

In the foregoing description, a paper of size A4 is conveyed in a laterally long position in order to produce a full-color copy. For a three- or two-color copy, the above procedure will be repeated a number of times corresponding to the number of desired colors and the number of desired copies. For a single-color or monocolor copy, the developing chamber storing the toner of desired color is continuously held at the developing position until the desired number of copies have been produced. At the same time, the blade of the cleaning unit 452 is continuously pressed against the belt 426.

Assume that the above apparatus is operated to produce a full-color copy with a paper of maximum size A3. Then, it is efficient to form an image of one color on the belt 426 every time the belt 426 makes one rotation, and to complete a four-color image when it ends four consecutive rotations. However, when the belt 426 is provided with the smallest possible circumferential length matching the maximum size A3, there arise a problem that, e.g., a period of time necessary for the scanner 200 to return is not available. On the other hand, if the belt 426 is sized on the assumption of the maximum size, then a substantial period of time is simply wasted when use is made of papers of size A4 or B5 smaller than A3. This is critical because papers of sizes A4 and B5 are used more often than papers of size A3. In light of this, for a copy of size A3, an image of one color is formed on the belt 426 while the belt 426 makes two rotations. Specifically, after the transfer of the Bk toner image from the drum 402 to the belt 426, the belt 426 makes a single idle rotation without any development or image transfer effected. Then, during the next one rotation of the belt 426, the next toner image is transferred to the belt 426 over the Bk toner image.

The above idle rotation scheme reduces the required length of the belt 426, insures a preselected copying speed even with copies of small sizes, and prevents the maximum allowable size from being reduced. During the idling, the scanner 200 can be returned to its home position. However, when a full-color image is desired, the toner image existing on the belt 426 passes by the discharger 454 six consecutive times. This aggravates the frequency of deposition of free toner particles on the wire of the discharger 454.

In any case, in the apparatus of the type using the intermediate transfer medium, the toner image formed on the medium passes by the discharger 454 for the repeated image transfer. The free toner particles are apt to deposit on the wire of the corona discharger 454. This is particularly true with a laminate color portion, e.g., blue-violet portion.

Figure 10:
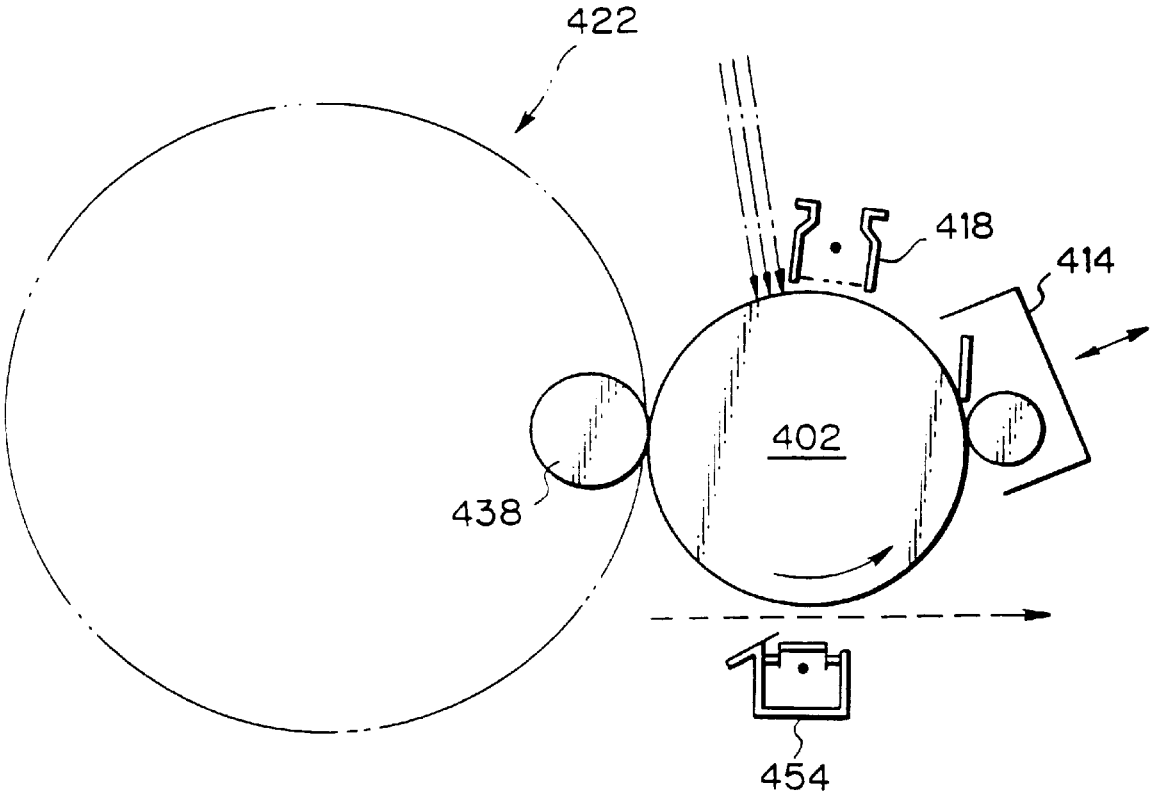
FIG. 10 is a fragmentary view showing an electrostatic image forming apparatus of the type lacking the intermediate transfer medium.

Referring to FIG. 10, a color image forming apparatus of the type not using the intermediate transfer belt 426 will be described. In FIG. 10, the same or similar constituents as the constituents of FIG. 9 are designated by like reference numerals. As shown, the charger 418, exposing means identical with the optical writing unit 400 of FIG. 8, revolver 422, corona discharger 454 and drum cleaning unit 414 are sequentially arranged around the drum 402 in the direction of rotation of the drum 402. After the charger 418 has uniformly charged the surface of the drum 402 to the negative polarity, the exposing means exposes the drum 402 imagewise so as to form a latent image thereon. The revolver 422 develops the latent image with negatively charged toner to thereby produce a corresponding toner image.

A paper or similar recording medium is conveyed to between the drum 402 and the discharger 454 facing the drum, as indicated by a dashed arrow in FIG. 10. At this instant, the discharger 454 effects corona discharge at the rear of the paper. As a result, the paper is charged to the positive polarity opposite to the polarity of the toner image. In this condition, the toner image is transferred from the drum 402 to the paper. A separation charger is constructed integrally with the charger 454 and separates the paper from the drum 402.

In a full-color mode, the apparatus without the belt 426, like the apparatus with the belt 426, sequentially forms color images on the drum 402 one above the other while holding the drum cleaning unit 414 spaced from the drum 402. The resulting full-color toner image is transferred from the drum 402 to the paper. Subsequently, the cleaning unit 414 is brought into contact with the drum 402 in order to clean it. Again, the toner image moves above the discharger 454 repeatedly without the paper existing between the drum 402 and the discharger 454. As a result, the free toner particles are apt to deposit on the wire of the discharger 454.

A first embodiment of the present invention to be described is based on the apparatus shown in FIG. 10 and lacking the intermediate transfer medium. A second embodiment to be also described is based on the apparatus shown in FIG. 9 and having the intermediate transfer medium. The first and second embodiments both include polarity switching means for selectively applying a voltage of substantially the same polarity as the toner to the wire of the discharger 454. The configuration common to the two embodiments will be described with reference to FIG. 1.

As shown in FIG. 1, the discharger 454 has a discharge wire 1. The toner is assumed to be charged to the negative polarity. The terminal of the wire 1 is selectively connected to the positive terminal of a power source 2 or the negative terminal of a power source 3 by a switch 4.

In a usual transfer mode, i.e., in the event of image transfer to a paper, it is necessary to apply a voltage opposite in polarity to the toner to the wire 1. For this purpose, the switch 4 is operated to connect the wire 1 to the power source 2. In a mode other than the usual transfer mode, e.g., when a laminate toner image is to be formed, the toner image passes by the discharger 454 without a paper existing between the drum 402 and the discharger 454. At this instant, to prevent free toner particles from depositing on the wire 1, the switch 4 is operated to connect the wire 1 to the power source 3 and thereby applies the negative voltage to the wire 1. This mode will be referred to as a clean mode hereinafter in the sense that the discharger 454 is maintained clean. The switch 4 is a specific form of polarity switching means. Assume that the voltage applied from the power source 2 is of substantially the same polarity as the toner; the word "substantially" is used in consideration of the relation between the above voltage and the charge actually deposited on the toner.

Figure 5:
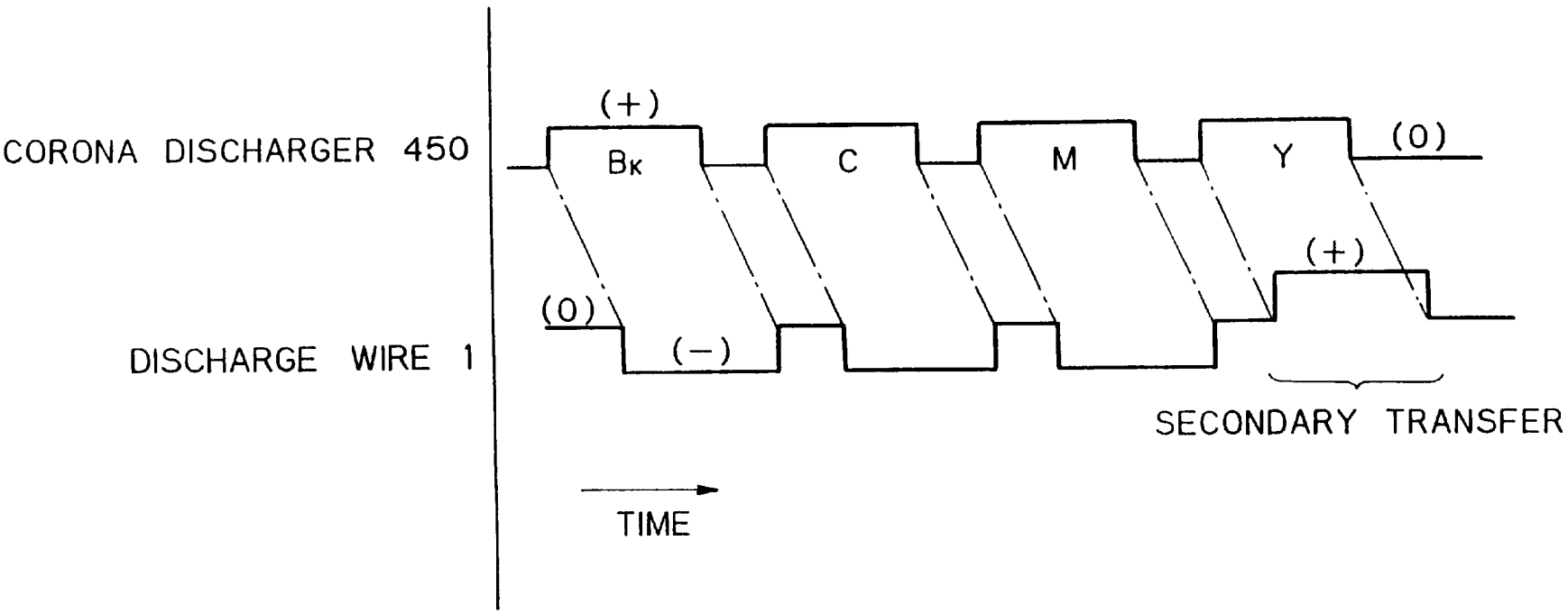
FIG. 5 is a timing chart representative of a relation between a primary transfer voltage and a secondary transfer voltage.

In the apparatus shown in FIG. 9 and having the intermediate transfer medium, the negative voltage is applied from the power source 3 to the wire 1 only when the Bk, C, M and Y toner images transferred to the belt 426 by the discharger 450 move over the discharger 454, as shown in FIG. 5. This successfully prevents free toner particles from depositing on the wire 1. When the four-color toner image including the last Y toner image is brought to the discharger 454 (secondary image transfer), the positive voltage opposite in polarity to the toner is applied from the power source 2 to the wire 1.

In the apparatus of the type lacking the intermediate transfer medium, a laminate or composite toner image is formed on the drum 402 by a procedure similar to the above procedure. Therefore, only when the toner image moves over the discharger 454 without a paper existing between the drum 402 and the discharger 454, the negative voltage is applied from the power source 3 to the wire 1 so as to prevent free toner particles from depositing on the wire 1. When the laminate toner image including the last or Y toner image moves over the discharger 454 together with a paper, the positive voltage opposite in polarity to the toner is applied from the power source 2 to the wire 1.

A third and a fourth embodiment to be described are respectively based on the apparatus shown in FIG. 10 and the apparatus shown in FIG. 9. The third and fourth embodiments both apply a voltage to the casing of the corona discharger 454 in addition to the wire 1. The configuration common to the two embodiments will be described with reference to FIG. 2.

Figure 2:
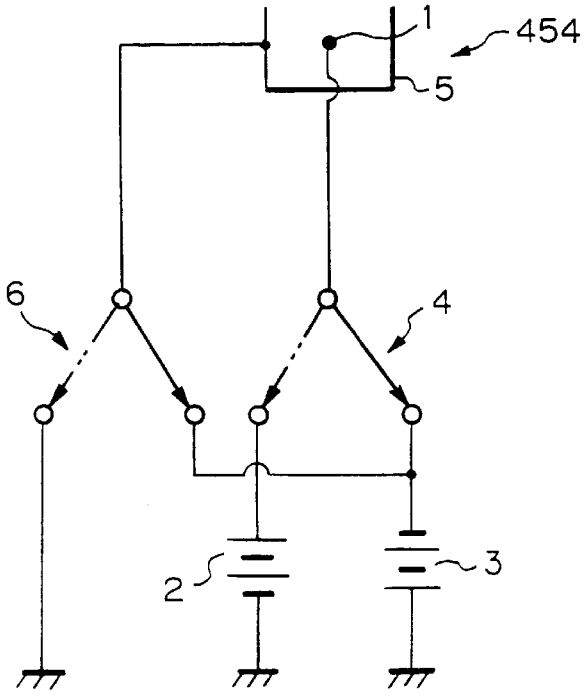
FIG. 2 is a circuit diagram showing means for switching voltages to be applied to the discharge wire and a casing also included in the corona discharger.

As shown in FIG. 2, the voltages of the power sources 2 and 3 are selectively applied to the wire 1 via the switch 4, as in the previous embodiments. In addition, a switch 6 selectively connects a casing 5 accommodating the wire 1 to the power source 3 or ground. The switches 4 and 6 are operated in interlocked relation.

In the usual transfer mode, i.e., in the event of image transfer to a paper, the casing 5 must be connected to ground in order to apply a positive voltage opposite in polarity to the toner to the wire. For this purpose, the switch 4 is operated to connect the wire 1 to the power source 2 while the switch 6 is operated to connect the casing 5 to ground.

In the clean mode in which the toner image moves over the discharger 454 without a paper existing between the drum 402 and the discharger 454, both the wire 1 and the casing 5 are connected to the power source 3 by the switches 4 and 6, respectively. In this condition, free toner particles are prevented from depositing on the wire 1 and casing 5. This is desirable because freeing the casing 5 from free toner particles further promotes the prevention of the deposition of such particles on the wire 1. The voltage is applied to the casing 5 at the same time as the voltage applied to the wire 1.

Figure 6:
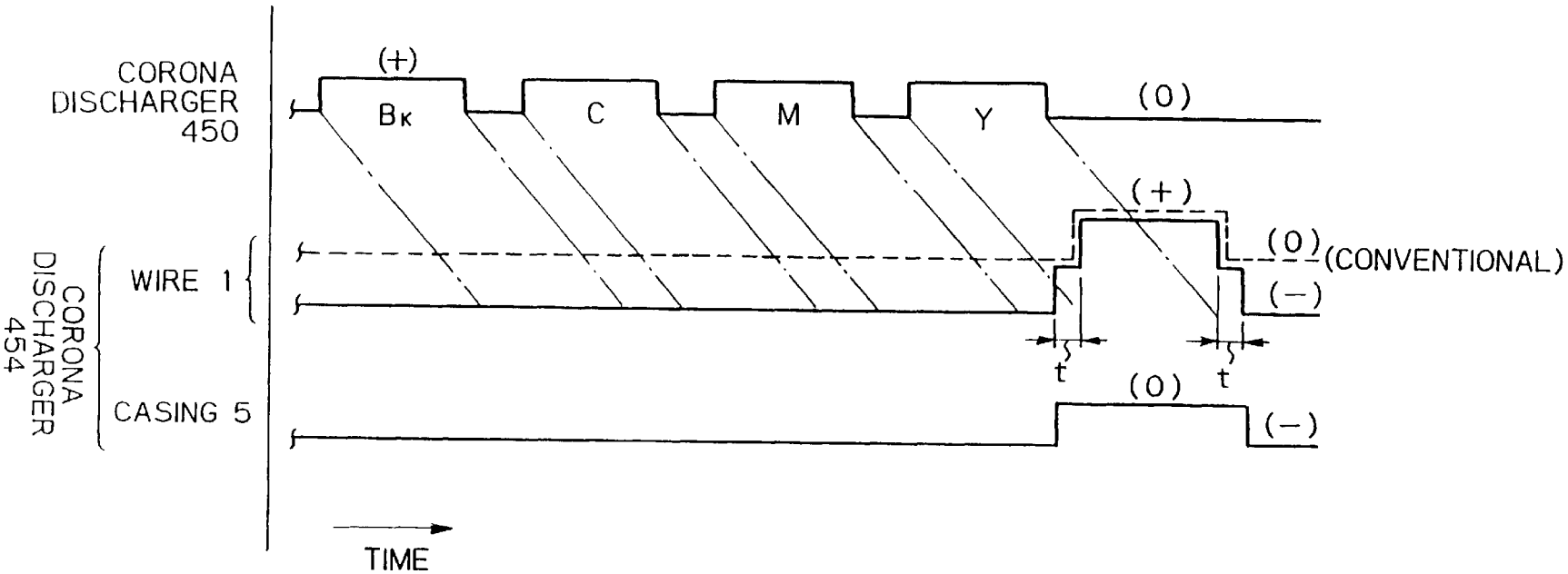
FIG. 6 is a timing chart representative of a relation between the timing for applying the primary transfer voltage and the timing for applying the secondary transfer voltage.

FIG. 6 shows how the voltage is applied to the casing 5 in the apparatus of the type having the intermediate transfer medium (FIG. 9). As shown, only when the four-color toner image including the last or Y toner image moves over the discharger 454 (secondary image transfer), the positive voltage opposite in polarity to the toner is applied to the wire 1 while the casing 5 is connected to ground. In other conditions, the negative voltage is applied to the wire 1 and casing 5. In FIG. 6, the positive and negative going edges of the positive voltage applied to the wire 1 are shown as being stepwise because of switching times t ascribable to the use of a high-tension relay.

In the apparatus shown in FIG. 10, it is assumed that the toner image transferred from the drum 402 to the belt 426 by the discharger 450 is replaced with the toner image formed by the revolver 422, and that the voltage for the discharger 454 is switched over accordingly.

In the clean mode, the voltages are applied to the wire 1 and casing 5 at the same time and of the same polarity as the toner may be equal to each other, as shown in FIG. 2. However, because the crux is that the wire 1 be free from the deposition of toner, the voltage applied to the wire 1 is selected to be higher than or equal to the voltage applied to the casing 5 in absolute value.

Figure 3:
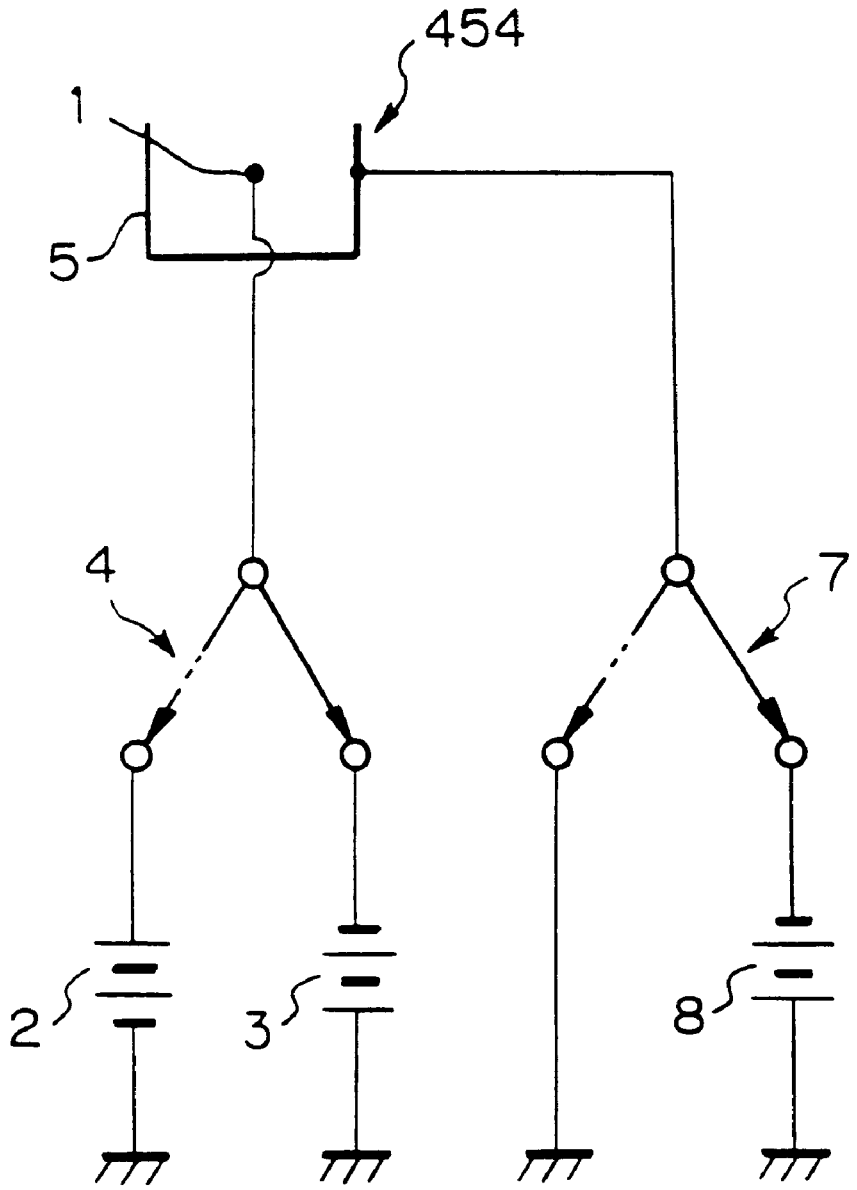
FIG. 3 is a circuit diagram showing alternative means for switching voltages to be applied to the discharge wire and casing.

Specifically, as shown in FIG. 3, a circuit including a switch 7 is substituted for the circuit including the switch 6 (FIG. 2). The switch 7 selectively connects the casing 5 to a negative power source 8 or to ground in interlocked relation to the switch 4. When the wire 1 is connected to the power source 3, the casing 5 is connected to the power source 8; when the former is connected to the power source 2, the latter is connected to ground.

Assuming that the voltage of the power source 3 is −1.7 kV, then the voltage of the power source 8 is selected to be −1 kV. In this condition, free toner particles of negative polarity are dissipated from the wire 1 more positively than from the casing 5. The power sources 3 and 8 are subjected to constant voltage control. The power source 2 outputs a voltage of 5 kV to 7 kV and is subjected to constant current control at +200 $\mu$A. When the voltages of the power sources 3 and 8 are equal to each other, they may be −1.7 kV.

In the above embodiments, it is necessary that the voltage applied to the wire 1 in the clean mode be lower in absolute value than the voltage applied to the wire 1 in the usual transfer mode. If this relation is inverted, then the voltage assigned to the clean mode and of the same polarity as the toner is higher in absolute value than the voltage assigned to the transfer mode because the latter voltage is high enough to effect corona discharge. As a result, corona discharge directly acts on the toner due to the absence of a paper and thereby disturbs the toner image to a critical degree.

Figure 7:
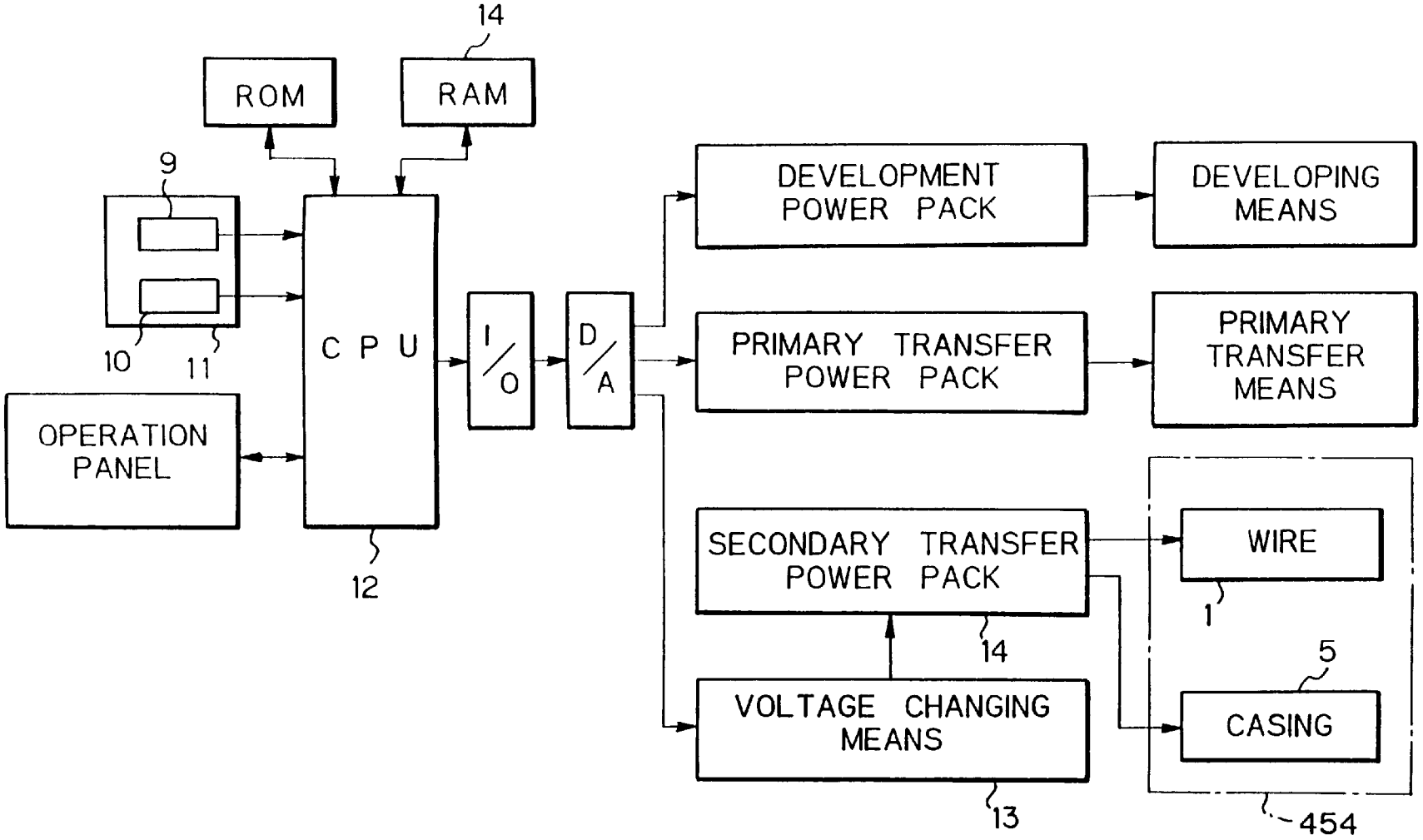
FIG. 7 is a block diagram schematically showing means for applying the secondary transfer voltage.

Also, in the above embodiments, assume that charge is deposited on the drum 402 or the belt 426 in an amount Q, and that the toner has a mass M. Then, the ratio Q/M and the amount of free toner particles are closely related to each other. It is generally accepted that the amount of free toner particles increases with a decrease in the ratio Q/M. The ratio Q/M is related to the absolute humidity which is determined by temperature and humidity. In light of this, as shown in FIG. 7, a temperature sensor 9 and a humidity sensor 10 are disposed in or in the vicinity of the apparatus and constitute environment sensing means 11. The output of the environment sensing means 11 is fed to a CPU (Central Processing Unit) 12.

In FIG. 7, the CPU 12 determines an absolute humidity on the basis of the outputs of the environment sensing means 11. The CPU 12 is capable of reading Q/M data varying in association with the absolute humidity out of a RAM (Random Access Memory) 14. Specifically, the RAM 14 stores data to be used as a reference value for determining, when a n absolute humidity is determined by the CPU 12, a voltage to be applied to the discharger 454 and matching the absolute humidity and optimal for dissipating free toner particles. Assume that the RAM 14 stores reference values 1 and 2. Then, when the absolute humidity is lower than the reference value 1, the voltage assigned to the discharger 454 is switched to a value a higher than a preselected value; when the absolute value is lower than the reference value 2, the voltage is switched to a value β lower than the preselected value.

The CPU 12 sends a control signal to voltage changing means 13 such that the voltage α or β is applied to the wire 1 while a voltage lower than α or β is applied to the casing 5 at a predetermined timing. A secondary transfer power pack 14 includes a power source and polarity switching means. In response to the output of the voltage changing means 13, the power pack 14 applies the preselected voltage to the discharger 454 at a preselected timing in the image transfer mode or the clean mode. Further, in a low atmospheric pressure environment, e.g., on a highland, the discharger 454 easily discharges and disturbs images. In light of this, the atmospheric pressure may be sensed and used to change the voltage assigned to the discharger; on the fall of the pressure, the voltage will be lowered.

In the first and second embodiments, the intermediate transfer medium is implemented as a belt or a drum having medium resistance, i.e., a volume resistivity of $1\times10^8$ Ωcm to $10^{12}$ Ωcm and a surface resistivity of $1\times10^8$ Ω to $10^{11}$ Ω (JIS K6911), as mentioned with reference to FIG. 9. Because the force for retaining the toner and available with such a transfer medium is weak, it is apt to cause much free toner to occur. In this sense, the polarity switching means included in the first and second embodiments frees the wire 1 of the discharger 454 from free toner more positively.

In all the embodiments described so far, the voltage assigned to the wire 1 in the clean mode should only be capable of preventing free toner particles from depositing on the wire 1; higher voltages would cause corona discharge to occur and would thereby disturb toner images. Therefore, the voltage applied to the wire 1 in the clean mode is so selected as not to bring about discharge. The voltage applied to the wire 1 in the clean mode is assumed to have a DC waveform, AC waveform, DC-biased pulse waveform, or asymmetrical pulse waveform. The crux is that the voltage be of the same polarity as free toner particles and be capable of preventing such particles from depositing on the wire 1. Assume that the wire 1 has a diameter of 60 $\mu$m, that the amount of charge Q/M of toner deposited on the belt 426 is −30 $\mu$C/g, that temperature and relative humidity are respectively 23° C. and 65%, and that the paper is of the kind having a unit weight of 70 kg. Under these conditions, desirable results were achieved when the voltage to be applied to the wire 1 in the transfer mode was subjected to 1.7 kV constant voltage control, and when the voltage to be applied to the wire 1 in the clean mode was 5.0 kV to 7.0 kV and subjected to +200 $\mu$A constant current control.

Figure 4:
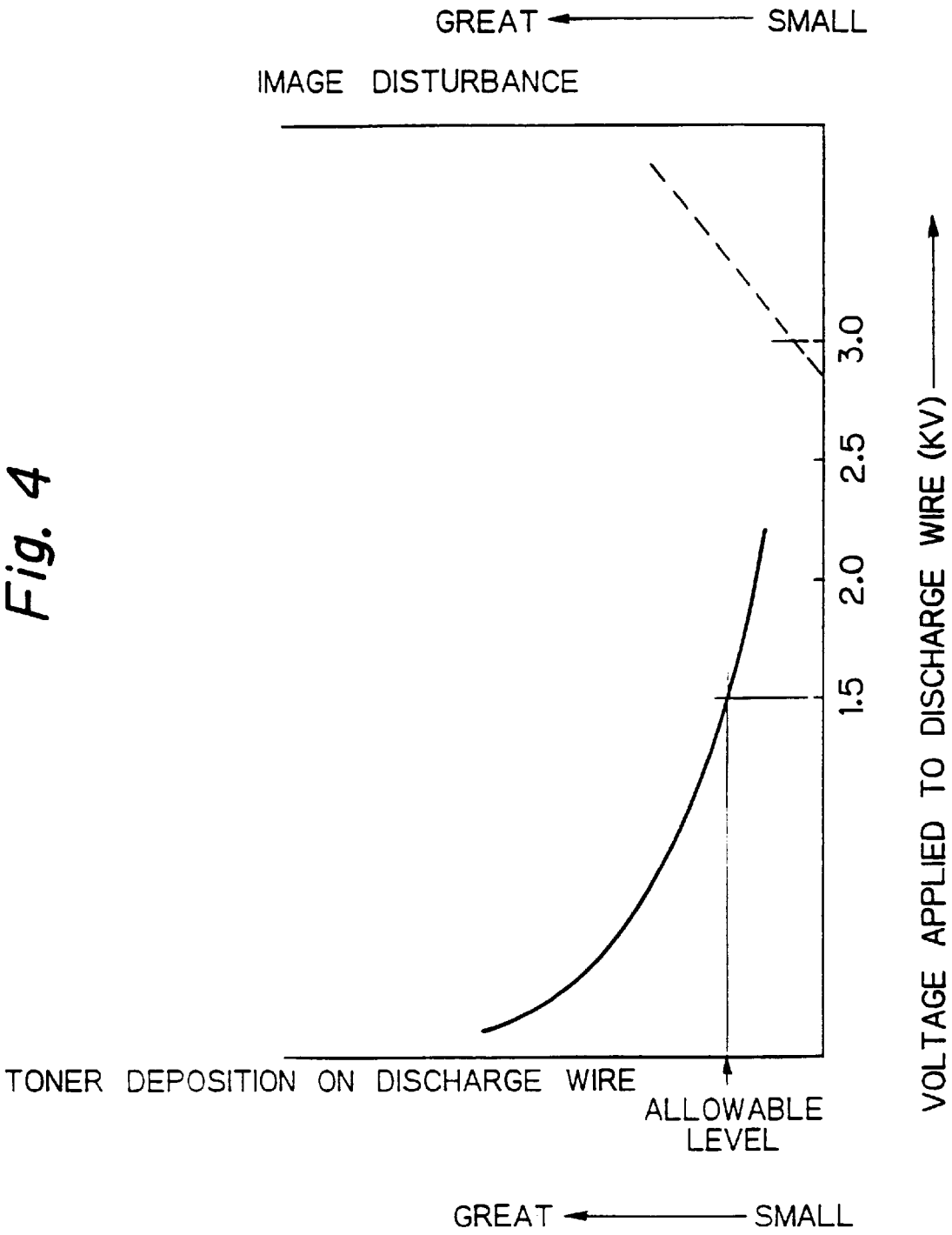
FIG. 4 is a graph indicative of the influence of the voltage on the discharge wire.

FIG. 4 accounts for the above results of experiments. In FIG. 4, the abscissa indicates the voltage applied to the wire 1 in the clean mode while the ordinate indicates the amount of toner deposited on the wire 1 and the disturbance to an image. As shown, when the voltage assigned to the wire 1 reaches and exceeds 1.5 kV, the toner deposition on the wire 1 is reduced below the allowable level. However, when the voltage exceeds at least 2.5 kV, it disturbs the toner image formed on the belt 426. Specifically, although the toner deposition on the wire 1 is reduced, the resulting toner image is defective. Hence, the voltage should not exceed at least 2.5 kV.

Figure 11:
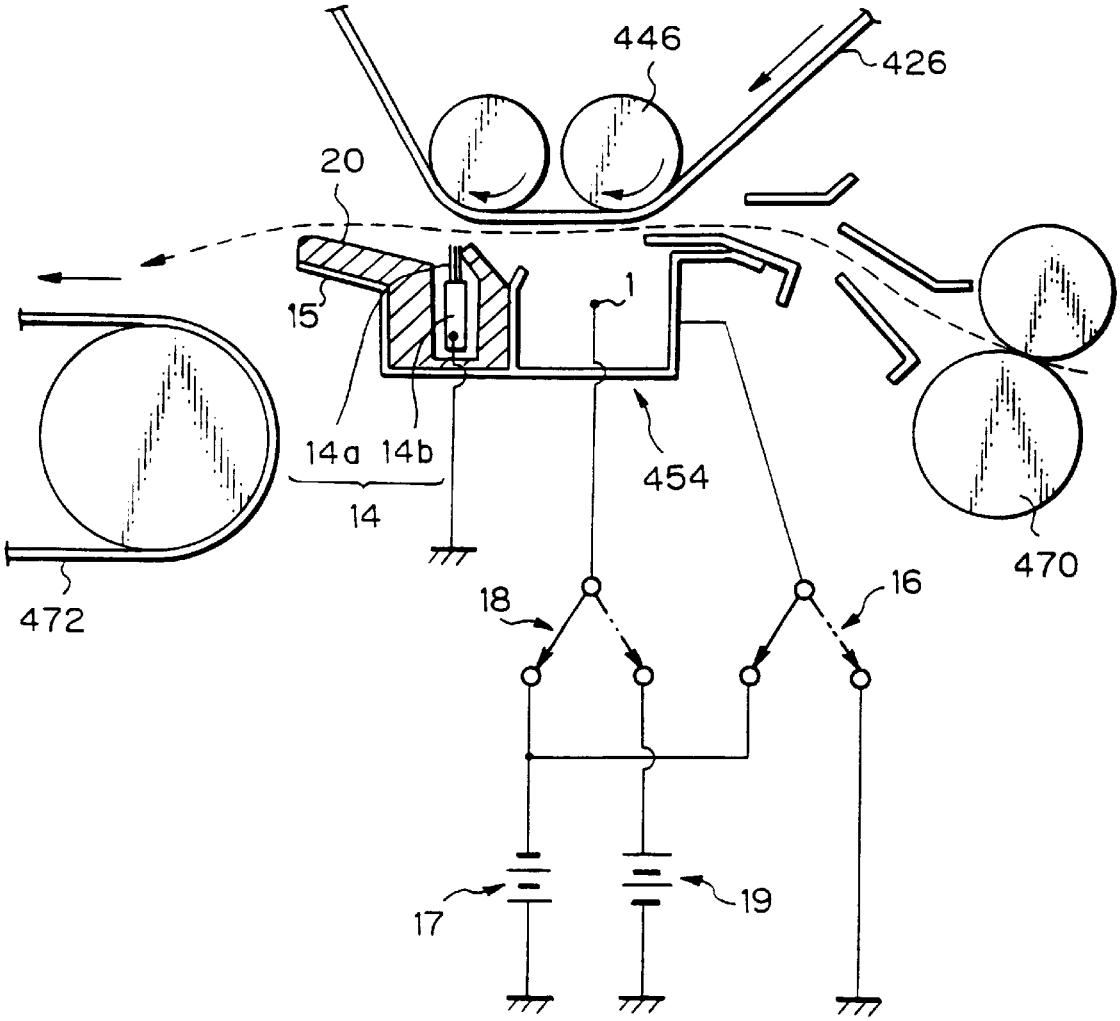
FIG. 11 is a fragmentary view of an electrostatic image forming apparatus having discharging means constructed integrally with a corona discharger.

A fifth embodiment to be described is applicable to both the apparatus shown in FIGS. 8 and 9 and the apparatus shown in FIG. 10. The fifth embodiment will be described on the assumption of an apparatus using an intermediate transfer medium, as shown in FIG. 11. The embodiment is practicable even with the apparatus shown in FIG. 10 only if the corona discharger 454 shown in FIG. 11 and its associated members are replaced with the discharger 454 of FIG. 10.

In FIG. 11, a paper is conveyed in a direction indicated by a dashed arrow. Discharging means 14 is positioned downstream of the discharger or secondary transfer means 454 in the direction of paper transport. The discharging means 14 used to discharge the paper is made up of a conductive electrode portion 14*a* and a conductive base 14*b*. The electrode portion 14*a* is implemented as a brush member or a needle member formed of stainless steel. The brush or needles 14*a* are implanted in the base 14*b* at intervals of, e.g., 0.5 mm. Stainless steel may be replaced with any other suitable conductive material, if desired. The electrode portion 14*a* is connected to ground via the base 14*b*.

The discharging means 14, like the discharger 454, extends in the widthwise direction perpendicular to the direction in which the belt 426 is movable. The discharging means 14 is positioned in close proximity to the belt 426 (or image carrier implemented as a photoconductive drum), but spaced from the belt 426 by, e.g., 4 mm. A generally U-shaped conductive member or plate 15 surrounds the discharging means 14 from the upstream side to the downstream side with respect to the direction of paper transport. The conductive plate 15 also extends in the widthwise direction perpendicular to the direction in which the belt 426 is movable. The upright wall of the plate 15 located at the upstream side is formed integrally with the casing of the discharger 454. The plate 15 is connected to a power source 17 via the casing of the discharger 454 and a switch 16. The power source 17 is of the same polarity as the toner deposited on the belt 426 (or drum 402). The wire 1 of the discharger 454 is connected to a power source 19 via a switch 18. The power source 19 is also of the same polarity as the toner deposited on the belt 426 (or drum 402). The switches 16 and 18 are operated in interlocked relation. When a voltage opposite in polarity to the toner is applied to the wire 1, a voltage of the same polarity as the toner is applied to the plate 15. When a voltage of the same polarity as the toner is applied to the wire 1, a voltage opposite in polarity to the toner is applied to the plate 15. The switch 16 and power source 17 constitute a specific form of voltage applying means for applying a voltage of the same polarity as the toner to the plate 15.

A guide member 20 is disposed in the plate 15 in order to guide the paper being conveyed away from the image transfer position. While the guide member 20 is indicated by hatching for the sake of convenience, it has a slit-like configuration extending in the previously mentioned widthwise direction. Such a configuration minimizes the area over which the guide member 20 contacts the paper.

In the above construction, the switches 16 and 18 are operated at the same timing as the voltage application to the discharger 454 described with reference to FIG. 6. As for the apparatus of the type lacking the intermediate transfer medium, the switches 16 and 18 are operated in accordance with the timing shown in FIG. 5. Specifically, the switch 18 is operated at the same timing as the voltage application to the wire 1 (FIG. 5), and the switch 16 is operated in interlocked relation to the switch 18.

Assume that the toner forming the toner image is of negative polarity. Then, the switches 16 and 18 are brought to positions indicated by dash-and-dots line in FIG. 11 when, e.g., a toner image of the first color formed on the belt 426 moves over the discharging means 14, i.e., when a toner image is not transferred to a paper. When the negative voltage identical in polarity with the toner deposited on the belt 426 is applied to the conductive member 15, the member 15 and the toner electrically repulse each other. As a result, the toner is prevented from flying toward the discharging means 14. Stated another way, a voltage of the same polarity as the toner cannot be applied to the discharging means 14 itself, it is applied to the conductive plate 15. This cancels the electric field containing the discharging means 14 which electrically reduces the scattering of the toner. As a result, the toner is electrically pressed against the belt 426 and prevented from flying away from the intermediate transfer medium. This successfully frees the discharging means 14 from the toner.

In summary, in accordance with the present invention, a bias of the same polarity as the charge of free toner particles is applied to a corona discharger. Hence, free toner particles are dissipated from the discharger by an electrostatic force.

This obviates defective discharge and defective image transfer ascribable to the deposition of free toner particles on the discharger. Various modifications will become possible for those skilled in the art after receiving the teachings of the present disclosure without departing from the scope thereof. For example, the belt 426 may be replaced with a drum. The corona discharger may be replaced with, e.g., a transfer roller, transfer belt or transfer brush so long as it includes the discharging means. Such alternative transferring means may be so constructed as to be movable toward and away from the intermediate transfer medium; it will be released from the medium when a toner image simply moves away without being transferred to a recording medium. The charge polarity of the toner, the polarity of the voltage applied to the transferring means or the discharging means, and the value of the voltage shown and described are only illustrative. The present invention is practicable not only with an apparatus having the intermediate transfer medium, but also with the transferring means or the discharging means of an apparatus of the type directly transferring toner from a photoconductive element to a recording medium, as stated earlier. For example, when a plurality of images are formed, no papers exist between the images, so that the transferring means or the discharging means directly faces the photoconductive element. In this condition, the present invention prevents the toner deposited on the background of the photoconductive element from depositing on the transferring means or the discharging means.

What is claimed is:

1. An electrostatic image forming apparatus comprising:

an image carrier for forming a toner image thereon;

a corona discharger facing said image carrier and having a conductive casing and a discharge wire disposed in said casing, and for effecting corona discharge at a rear of a recording medium fed thereto, wherein the corona discharger charges the recording medium to a polarity opposite to a charge polarity of the toner image formed on said image carrier and thereby transfers the toner image to the recording medium;

voltage changing means for applying a voltage of substantially a same polarity as a charge of the toner image to at least said discharge wire of said corona discharger, and for changing said voltage;

environment sensing means for sensing an environment in which said apparatus is situated, the environment sensed including a temperature and a humidity of said apparatus; and control means for controlling, based on the environment sensed, the voltage to be applied by said voltage changing means.

2. An apparatus as claimed in claim 1, wherein the voltage of substantially the same polarity as the toner has one of a DC waveform, an AC waveform, a DC-biased pulse waveform, and an asymmetrical pulse waveform.

3. An apparatus as claimed in claim 1, wherein a constant voltage of substantially a same polarity as the toner is applied to said corona discharger.

4. An electrostatic image forming apparatus comprising:

an image carrier for forming a toner image thereon;

charging means for uniformly charging said image carrier in the event of an image formation;

exposing means for exposing said image carrier charged in accordance with image data to thereby form a latent image;

developing means for developing the latent image with toner to thereby produce a corresponding toner image;

an intermediate transfer medium having a medium resistance;

primary transfer means applied with a voltage opposite in polarity to the toner image for transferring the toner image to said intermediate transfer medium;

secondary transfer means applied with a voltage opposite in polarity to the toner image carried on said intermediate transfer medium, and for transferring the toner image from said intermediate transfer medium to a recording medium, wherein said secondary transfer means comprises a corona discharger made up of a conductive casing and a discharge wire disposed in said casing;

voltage changing means for applying a voltage of substantially a same polarity as a charge of the toner image to at least said discharge wire of said corona discharger, and for changing said voltage;

environment sensing means for sensing an environment in which said apparatus is situated, the environment sensed including a temperature and a humidity of said apparatus; and control means for controlling, based on the environment sensed, the voltage to be applied by said voltage changing means.

5. An apparatus as claimed in claim 4, wherein the voltage of substantially the same polarity as the toner has one of a DC waveform, an AC waveform, a DC-biased pulse waveform, and an asymmetrical pulse waveform.

6. An apparatus as claimed in claim 4, wherein a constant voltage of substantially a same polarity as the toner is applied to said corona discharger.

* * * * *